US006745727B1

(12) United States Patent
Kramer et al.

(10) Patent No.: US 6,745,727 B1
(45) Date of Patent: Jun. 8, 2004

(54) ENGINE- AND VEHICLE- SPEED-BASED ENGINE COOLING FAN CONTROL

(75) Inventors: Thomas M. Kramer, Elmhurst, IL (US); Jeffery D. Jenks, Oak Park, IL (US); James T. Beaucaire, Glen Ellyn, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 10/463,157

(22) Filed: Jun. 16, 2003

(51) Int. Cl.[7] ..... F01P 7/02
(52) U.S. Cl. ..... 123/41.11
(58) Field of Search ..... 123/41.65, 41.11, 123/41.12

(56) References Cited

U.S. PATENT DOCUMENTS 5,765,672 A * 6/1998 Briggs et al. ..... 192/85 R

* cited by examiner

*Primary Examiner*—Andrew M. Dolinar
*Assistant Examiner*—Katrina B. Harris
(74) *Attorney, Agent, or Firm*—Dennis Kelly Sullivan; Susan L. Lukasik; Jeffrey P. Calfa

(57) ABSTRACT

An engine cooling fan (18) is coupled to an engine (14) of a truck (10) through an electric-operated clutch (20) for selectively placing the cooling fan in driven and non-driven relationship with the engine. A control system (22) processes certain data for indicating when engine speed (N) exceeds a reference engine speed (EFC_N_LMX), for indicating when vehicle speed (VSS) exceeds a reference vehicle speed EFC_VSS_LMX), and for indicating when rate of change of engine speed exceeds a selected rate of change of engine speed. The clutch places the fan in non-driven relationship with the engine when the processing discloses vehicle speed exceeding the reference vehicle speed coincident with the processing of the data disclosing either engine speed exceeding the reference engine speed or rate of change of engine speed exceeding the selected rate of change of engine speed.

16 Claims, 2 Drawing Sheets

ENGINE- AND VEHICLE- SPEED-BASED ENGINE COOLING FAN CONTROL

FIELD OF THE INVENTION

This invention relates to motor vehicles powered by heat engines, such as trucks that are powered by internal combustion engines.

BACKGROUND OF THE INVENTION

A thermodynamic system in which mechanical energy is extracted from heat energy must reject some heat as waste heat. Heat transfer occurs through one of three phenomena: conduction, convection, and radiation. In the case of a heat engine, such as an internal combustion engine of a motor vehicle, that converts heat energy of combustion into mechanical energy for powering the vehicle, the amount of heat that needs to be rejected typically requires that the engine have its own cooling system, typically air-cooled or liquid-cooled. Air-cooling, where heat transfer occurs directly from the engine to ambient air, may be adequate for certain small engines, but motor vehicles that are powered by large engines typically require a liquid cooling system for the engine.

As liquid coolant is circulated through coolant passages in the engine block and heads that form the engine combustion chambers, some of the heat of internal combustion transfers by conduction to the circulating liquid. Coolant is circulated in a loop that runs from the engine to a heat exchanger, i.e. a radiator, and back to the engine. The radiator serves to reject heat from the circulating coolant by conductive transfer to ambient air that flows through the radiator. The flow rate of ambient air through the radiator affects the heat transfer rate.

Placement of a radiator in a vehicle may seek to take advantage of ram air for forcing the flow of ambient air through the radiator. Under certain conditions, the ram air flow may be sufficient for adequate heat rejection. Under other conditions, it may not. Consequently, such a motor vehicle may have an engine cooling fan associated with the radiator to force ambient air through the radiator when ram air is inadequate.

Although it was once a common design practice for an engine cooling fan to be driven directly from the engine via a fan belt, various considerations like fuel economy and fan noise have impacted both cooling fan design and the way in which the cooling fan is driven. Whenever ram air flow is adequate for engine cooling needs, operation of an engine cooling fan is wasteful of energy. Hence, various forms of electric control for engine cooling fans have emerged, a basic purpose being to disconnect the fan from the engine when it is not needed, such as when ram air is sufficient to satisfy engine cooling needs.

An electro-mechanical device, such as a clutch, is one type of interface between an engine and its cooling fan. An electric signal selectively engages and disengages the clutch to selectively connect and disconnect the cooling fan to and from the engine. One way of developing the electric signal is via suitable algorithms in the processor of an electric engine control system.

Motor vehicles fall within the purview of certain government regulations. Fuel economy, tail-pipe emissions, and noise are examples such regulations. As an element for achieving compliance with applicable fuel economy regulations, it is desirable for certain engines to selectively connect and disconnect an engine cooling fan to and from the engine according to engine cooling needs. This type of fan control is sometimes called an "on-off" control.

Because operation of an engine cooling fan can contribute to the noise generated by a motor vehicle, it may be important to control fan noise as an element of compliance with applicable noise regulations. At the same time, it is important that such control not impede the attainment of adequate engine cooling when the fan needs to be used to achieve such cooling.

SUMMARY OF THE INVENTION

The present invention is directed toward a novel engine cooling fan control that takes into account both compliance with applicable government regulations and engine cooling needs so as to assure that both considerations are properly addressed in a new motor vehicle covered by such regulations. The invention has an advantage of being capable of implementation in an existing engine control system using existing hardware. This is because the inventive principles can be implemented as part of the cooling fan control strategy in a processor of the engine control system.

Accordingly, one generic aspect of the present invention relates to an engine cooling fan control in a motor vehicle powered by a heat engine having an engine cooling fan coupled to the engine through an interface that is operable to selectively place the cooling fan in driven and non-driven relationship with the engine. With the engine running, an engine control system controls the interface to place the cooling fan selectively in driven relationship with the engine for forcing ambient air to contribute to engine cooling and in non-driven relationship with the engine to discontinue forcing ambient air to contribute to engine cooling. The engine cooling fan control comprises a strategy in the control system for indicating when engine speed exceeds a reference engine speed, for indicating when vehicle speed exceeds a reference vehicle speed, and for indicating when rate of change of engine speed exceeds a selected rate of change of engine speed. The strategy causes the interface to place the cooling fan in non-driven relationship with the engine when vehicle speed exceeding the reference vehicle speed is indicated coincident with indication of either engine speed exceeding the reference engine speed or rate of change of engine speed exceeding the selected rate of change of engine speed.

Another generic aspect relates to a method of engine cooling fan control in a motor vehicle powered by a heat engine having a cooling fan that is operated selectively by the engine to force ambient air to contribute to engine cooling when placed in driven relationship with the engine and not to force ambient air to contribute to engine cooling when placed in non-driven relationship with the engine. The method comprises processing engine speed data, reference engine speed data, and selected rate of change of engine speed data to indicate engine speed exceeding a reference engine speed and to indicate rate of change of engine speed exceeding a selected rate of change of engine speed. Vehicle speed data and reference vehicle speed data are processed to indicate vehicle speed exceeding a reference vehicle speed. The cooling fan is placed in non-driven relationship with the engine when vehicle speed exceeding the reference vehicle speed is indicated coincident with indication of either engine speed exceeding the reference engine speed or rate of change of engine speed exceeding the selected rate of change of engine speed.

Still another generic aspect relates to a motor vehicle comprising a heat engine that powers the vehicle and comprises an engine cooling fan coupled to the engine through an interface that is operable to selectively place the cooling fan in driven and non-driven relationship with the engine. With the engine running, a control system controls the interface to place the cooling fan selectively in driven relationship with the engine for forcing ambient air to contribute to engine cooling and in non-driven relationship with the engine to discontinue forcing ambient air to contribute to engine cooling. The control system processes certain data for indicating when engine speed exceeds a reference engine speed, for indicating when vehicle speed exceeds a reference vehicle speed, and for indicating when rate of change of engine speed exceeds a selected rate of change of engine speed, and causes the interface to place the cooling fan in non-driven relationship with the engine when the processing of the data discloses vehicle speed exceeding the reference vehicle speed coincident with the processing of the data disclosing either engine speed exceeding the reference engine speed or rate of change of engine speed exceeding the selected rate of change of engine speed.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

DESCRIPTION OF THE PREFERRED EMBODIMENT

Figure 1:
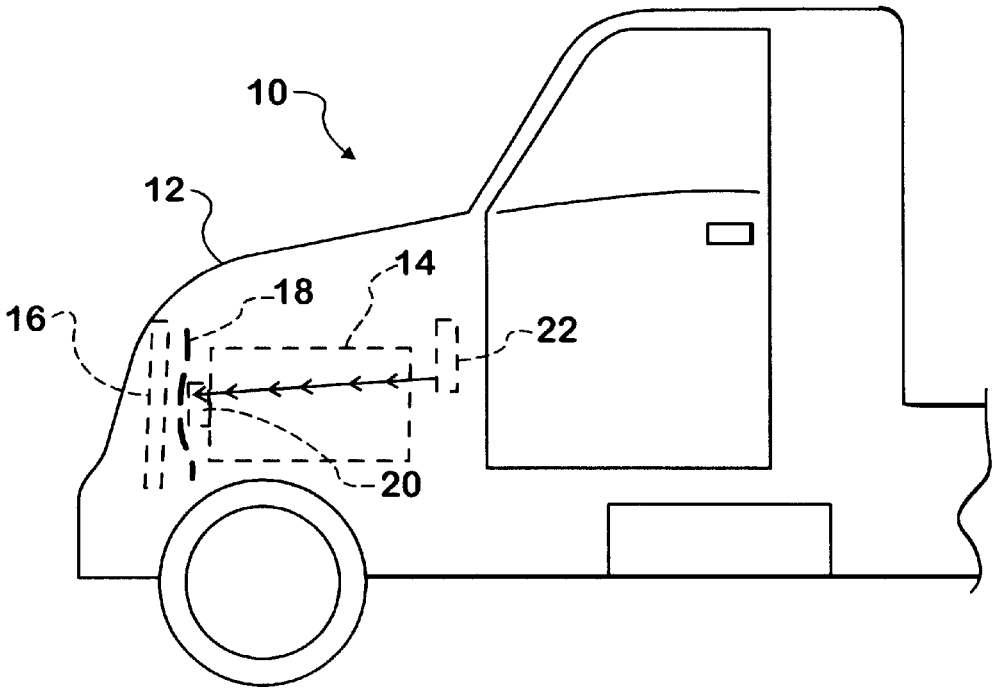
FIG. 1 illustrates a motor vehicle whose engine comprises a cooling fan control in accordance with principles of the present invention.

FIG. 1 shows a front portion of a truck 10 having an engine compartment 12 that houses an engine 14. The engine is coupled through a drivetrain to driven wheels (not shown) for propelling the truck when the truck is being driven. Engine 14 is shown by way of example as a diesel engine having its own liquid cooling system. Liquid coolant is circulated through coolant passages in the block and heads of engine 14 that form the engine combustion chambers. A pump is typically used to circulate the coolant.

Some of the heat of combustion created in the engine combustion chambers transfers by conduction to the coolant that circulates in a loop running from engine 14 to a frontally placed radiator 16, and back to the engine. Radiator 16 rejects heat from the circulating coolant by conductive transfer to ambient air flowing through the radiator. Frontal placement of radiator 16 takes advantage of ram air for forcing ambient air through the radiator when truck 10 is being propelled forwardly by engine 14.

Because ram air flow may at times be insufficient for adequate heat rejection, an engine cooling fan 18 is associated with 16 radiator to draw ambient air through the radiator. A clutch 20 that provides an interface between cooling fan 18 and engine 14 is operable to place fan 18 selectively in a driven relationship with engine 14 and in a non-driven relationship with engine 14. An electric signal provided by a control system 22 of engine 14 selectively engages and disengages clutch 20 to selectively connect and disconnect cooling fan 18 to and from engine 14.

Figure 2:
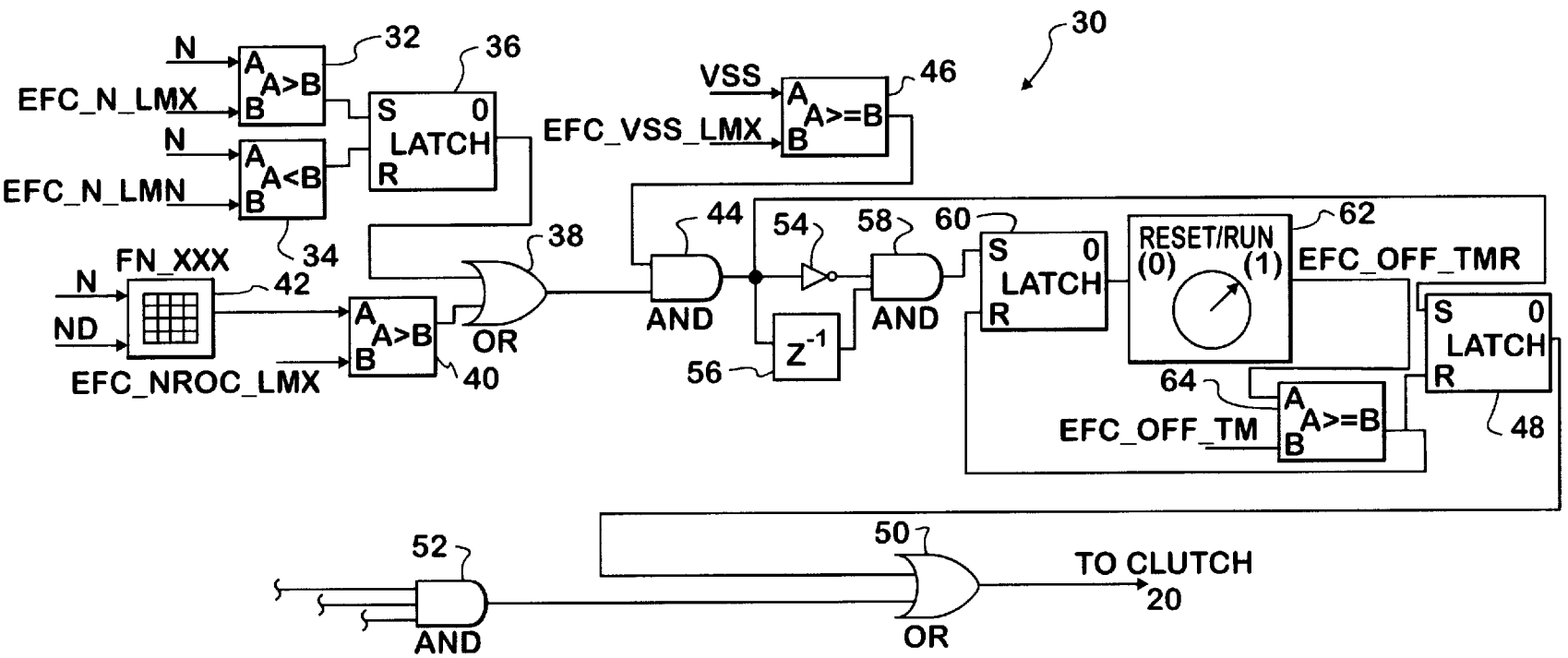
FIG. 2 is a software strategy diagram of the cooling fan control present invention.

Control system 22 comprises a processor that processes various data in performance of various engine-related functions. One function is the operation of clutch 20. The processor is programmed with algorithms that embody the inventive control strategy 30 for the selective operation of fan 18. That strategy is depicted in FIG. 2. The inventive strategy is one that causes a request for fan operation to be dishonored upon coincidence of certain vehicle speed, certain engine speed, and certain rate of change of engine speed conditions.

In FIG. 2, the data parameter N represents the speed at which engine 14 is running, i.e. engine speed, and the data parameter VSS represents the speed at which truck 10 is traveling, i.e. vehicle speed. The data parameter ND represents the rate at which engine speed is changing. Strategy 30 comprises a comparison function 32 that compares engine speed N with a parameter EFC_N_LMX that represents an engine speed above which a request for operation of fan 18 may be dishonored depending on vehicle speed. How vehicle speed impacts dishonor of a fan request will be explained later. Strategy 30 also comprises another comparison function 34 that compares engine speed N with a parameter EFC_N_LMN that represents an engine speed below which engine speed ceases to be a consideration in dishonoring a request for operation of fan 18. The data value represented by parameter EFC_N_LMX is larger than the data value represented by parameter EFC_N_LMN, and the difference between them effectively sets a limited hysteresis band to the low side of an engine reference speed above which a fan request may possibly be dishonored.

When engine speed N exceeds the engine speed EFC_N_LMX, comparison function 32 sets a latch function 36 to a latched state. When engine speed N becomes less than the engine speed EFC_N_LMN, comparison function 34 resets latch function 36 to an unlatched state.

Latch function 36 provides one input to an OR logic function 38. A second input to OR logic function 38 is from a third comparison function 40. Engine speed N and rate of change of engine speed ND are inputs to a look-up table 42 that contains data values of rate of change of engine speed correlated with data value pairs of engine speed and rate of change of engine speed.

Based on the data values for engine speed N and rate of change of engine speed ND, look-up table 42 furnishes a data value for rate of change of engine speed ND to comparison function 40. The use of look-up table 42 enables the rate of change of engine speed subsequently processed by comparison function 40 to be engine-speed-compensated. At certain steady state engine speeds, sudden increases in engine speed may cause aerodynamic noise spikes that could be objectionable to the vehicle operator and any persons in the ambient surroundings. Above a calibrateable limit, EFC_NROC_LMX, and depending on vehicle speed, a fan request may be dishonored to prevent sudden excess noise created by sudden and significant engine acceleration. While such speed compensation is a subsidiary feature of the invention, it is not essential to the broader aspects of the invention.

The parameter EFC_NROC_LMX represents a selected rate of change of engine speed above which a request for fan operation is to be dishonored depending on vehicle speed. The data value for EFC_NROC_LMX is the second input to comparison function 40. Comparison function 40 compares the data value for the speed-compensated rate of change of engine speed received from look-up table 42 with the data value for EFC_NROC_LMX. When the result of the comparison discloses that rate of change of speed-compensated engine speed exceeds the data value for EFC_

NROC_LMX, a logic "1" is supplied to OR logic function 38 for processing. Otherwise a logic "0" is supplied.

OR logic function 38 furnishes one data input to an AND logic function 44. A second input to AND logic function 44 is from a fourth comparison function 46. Comparison function 46 compares the data value for vehicle speed VSS with the data value for a parameter EFC_VSS_LMX that represents a vehicle speed at and above which a request for fan operation may be dishonored depending on engine speed and rate of change of engine speed, and below which engine speed, in accordance with the inventive strategy, has no effect on a request for fan operation. When the result of the comparison discloses that vehicle speed equals or exceeds the data value for EFC_VSS_LMX, function 46 supplies a logic "1" to AND logic function 44 for processing. Otherwise it supplies a logic "0".

Because AND logic function 44 requires a logic "1" from both OR logic function 38 and comparison function 46 in order to pass a logic "1" for further processing, the dishonoring of a request for fan operation that is based on engine speed or rate of change of engine speed is qualified by the prevailing vehicle speed. If the vehicle is traveling at or above a certain speed, engine speed and rate of change of engine speed will become considerations in dishonoring a fan request. In other words, with the vehicle traveling at or above the speed represented by EFC_VSS_LMX, requests for fan operation will be dishonored either if engine speed is also exceeding the engine reference speed above which the request should be dishonored or if rate of change of engine speed is also exceeding EFC_NROC_LMX.

Strategy 30 further comprises a second latch function 48 that is set to a latched state when it processes a logic "1" from AND logic function 44. When in the latched state, latch function 48 supplies a logic "1" as one input to another OR logic function 50. The other input to OR logic function 50 is from another AND logic function 52 that processes data inputs from multiple sources. Each of those other sources is capable of requesting or not requesting clutch engagement and hence requesting or not requesting fan operation. Examples of those other sources include: vehicle cabin air conditioner load, powertrain or transmission retarder engagement load, engine manifold (intake or exhaust) temperature level, engine coolant temperature, and state of radiator shutters.

The logical arrangement is such that all of those other sources must be requesting that clutch 20 not be engaged in order for AND logic function 52 to furnish a logic "1" for processing by OR logic function 50. Stated another way, if any one or more of those other sources is requesting clutch engagement, AND logic function 52 will furnish a logic "0" to OR logic function 50.

From the preceding description then, the reader can understand that when the processing of its input data values by OR logic function 50 yields a logic "1", clutch 20 operates to disengage fan 18 from engine 14, and when the processing yields a logic "0", clutch 20 operates to engage fan 18 with engine 14. In accordance with the inventive strategy, certain vehicle speeds, certain engine speeds, and certain engine accelerations (i.e. certain rates of change of engine speed) will be effective to cause a fan request from one or more of the sources processed by AND logic function 52 to be dishonored by disconnecting the fan from the engine. Hence, latch function 48, when set to its latched state, qualifies a request for fan operation by AND logic function 52, by overriding the request so as to render the request ineffective, while any of those certain vehicle speeds, certain engine speeds, and certain engine accelerations are occurring in the manner described above.

Consequently, clutch 20 places cooling fan 18 in non-driven relationship with engine 14 when vehicle speed exceeding the reference vehicle speed is indicated by comparison function 46 coincident with OR logic function 38 indicating either engine speed exceeding the reference engine speed as indicated by latch function 36 or rate of change of engine speed exceeding the selected rate of change of engine speed as indicated by comparison function 40.

Additional elements of strategy 30 include an inverting function 54, a store function 56, another AND logic function 58, another latch function 60, a timer function 62, and another comparison function 64. Collectively, these elements assure that a change in the output of AND logic function 44 from a logic "1" to a logic "0" is not due to a momentary fluctuation. They coact to require that a change in the output of AND logic function 44 from a logic "1" to a logic "0" persist for some minimum interval of time established by the data value of a parameter EFC_OFF_TM.

When the output of AND logic function 44 changes from a logic "1" to a logic "0", store function 56 will be storing a logic "1" as the value from the immediately prior iteration of the strategy. Inverting function 54 inverts the logic "0" so that AND logic function 58 sets latch function 60, causing timer function 62 to commence timing. When timer function 62 has timed out, it will try to reset latch function 48 to the unlatched state, but will be ineffective in doing so if the output of AND logic function 44 has received back to a logic "1". It will however be effective in resetting latch function 60 and hence resetting timer function 62.

The effectiveness of the invention is demonstrated by the following situations.

If truck 10 is accelerated sufficiently rapidly, while vehicle speed or exceeds EFC_VSS_LMX, comparison function 40 will act via OR function 38 and AND function 44 to cause fan 18 to be disconnected from engine 14 until the acceleration subsides, i.e. ceases to exceed EFC_NROC_LMX, or until vehicle speed falls below the speed corresponding to EFC_VSS_LMX, even though one or more of the sources processed by AND logic function 52 may be requesting fan operation.

If engine speed exceeds the speed represented by EFC_N_LMX, while vehicle speed equals or exceeds EFC_VSS_LMX, latch function 36 will act via OR function 38 and AND function 40 to cause fan 18 to be disconnected from engine 14, even though one or more of the sources processed by AND logic function 52 may be requesting, fan operation. Should engine speed fall below the speed represented by EFC_N_LMX, while vehicle speed remains at or above EFC_VSS_LMX, latch function 36 will be reset to allow clutch 20 to be engaged if AND logic function 52 is requesting fan operation.

When cooling fan 18 is not being driven by the engine, it does not draw power from the engine nor does it generate the fan noise that it otherwise might. While vehicle speed remains at or above EFC_VSS_LMX, any loss of air flow through radiator 16 due to dishonor of a fan request should be inconsequential because as vehicle speed continues to equal or exceed the speed corresponding to EFC_VSS_LMX, ram air should be sufficient by itself to provide ample cooling.

With engine 14 running while truck 10 is static or at most moving at a slow speed, as in PTO (Power Take Off) mode, the logic of the strategy allows fan operation to provide cooling as needed. Because engine speeds would be fairly low in such a mode (for example, 1400 rpm or less), it is unlikely that the fan noise generated would be deemed objectionable or non-compliant complaint with applicable government regulations.

The invention provides the advantages of allowing large diameter fans to used in conjunction with on-off electrically-controlled fan clutches while meeting compliance with applicable government regulations and promoting fuel economy. The disclosed strategy is executed by processing in control system 22 at an appropriate execution rate.

While a presently preferred embodiment of the invention has been illustrated and described, it should be appreciated that principles of the invention apply to all embodiments falling within the scope of the following claims.

What is claimed is:

1. An engine cooling fan control in a motor vehicle powered by a heat engine having an engine cooling fan coupled to the engine through an interface that is operable to selectively place the cooling fan in driven and non-driven relationship with the engine, and a control system that, with the engine running, controls the interface to place the cooling fan selectively in driven relationship with the engine for forcing ambient air to contribute to engine cooling and in non-driven relationship with the engine to discontinue forcing ambient air to contribute to engine cooling, the engine cooling fan control comprising:

a strategy in the control system for indicating when engine speed exceeds a reference engine speed, for indicating when vehicle speed exceeds a reference vehicle speed, and for indicating when rate of change of engine speed exceeds a selected rate of change of engine speed, and for causing the interface to place the cooling fan in non-driven relationship with the engine when vehicle speed exceeding the reference vehicle speed is indicated coincident with indication of either engine speed exceeding the reference engine speed or rate of change of engine speed exceeding the selected rate of change of engine speed.

2. An engine cooling fan control as set forth in claim 1 in which a portion of the strategy for indicating when engine speed exceeds the reference engine speed comprises strategy for comparing engine speed to a diminished engine speed reference that is less than the reference engine speed, and from a time at which engine speed begins to exceed the reference engine speed until a time at which engine speed ceases to exceed the diminished engine speed reference, for continuing the indication that engine speed exceeds the reference engine speed, and for discontinuing the indication that engine speed exceeds the reference engine speed when engine speed ceases to exceed the diminished engine speed reference.

3. An engine cooling fan control as set forth in claim 2 in which the portion of the strategy for indicating when engine speed exceeds the reference engine speed comprises a latch function that, once engine speed begins to exceed the reference engine speed, is latched in one latch state and that remains latched in that one latch state until engine speed ceases to exceed the diminished engine speed reference, and when engine speed ceases to exceed the diminished engine speed reference, is unlatched from that one latch state to a different state.

4. An engine cooling fan control as set forth in claim 3 in which the strategy comprises an OR logic function for monitoring the state of the latch function, for monitoring a comparison function that compares rate of change of engine speed to a reference rate of change of engine speed, and for indicating either engine speed exceeding the reference engine speed or rate of change of engine speed exceeding the selected rate of change of engine speed.

5. An engine cooling fan control as set forth in claim 4 in which the strategy comprises an AND logic function for monitoring the OR logic function, for monitoring a comparison function that compares vehicle speed to the reference vehicle speed for indicating coincidence of vehicle speed exceeding the reference vehicle speed, and either engine speed exceeding the reference engine speed or rate of change of engine speed exceeding the selected rate of change of engine speed.

6. An engine cooling fan control as set forth in claim 5 in which the strategy comprises a second latch function that is latched in one latch state by the AND logic function's indication of coincidence, for a selected minimum time interval, of vehicle speed exceeding the reference vehicle speed and either engine speed exceeding the reference engine speed or rate of change of engine speed exceeding the selected rate of change of engine speed.

7. An engine cooling fan control as set forth in claim 4 in which a look-up table that has engine speed and rate of change of engine speed as inputs provides the selected rate of change of engine speed used by the comparison function to thereby compensate the selected rate of change of engine speed used by the comparison function for engine speed.

8. An engine cooling fan control as set forth in claim 1 including additional strategies acting through an AND logic function for requesting the cooling fan be placed in non-driven relationship with the engine only when all of the additional strategies call for the cooling fan to be placed in non-driven relationship with the engine, and an OR logic function for causing the interface to place the cooling fan in non-driven relationship with the engine when either the AND logic function is requesting that the cooling fan be placed in non-driven relationship with the engine or when vehicle speed exceeding the reference vehicle speed is indicated coincident with indication of either engine speed exceeding the reference engine speed or rate of change of engine speed exceeding the selected rate of change of engine speed.

9. An engine cooling fan control as set forth in claim 1 in which the strategy is effective to override any other request requesting that the cooling fan be placed in driven relationship with the engine.

10. A method of engine cooling fan control in a motor vehicle powered by a heat engine having a cooling fan that is operated selectively by the engine to force ambient air to contribute to engine cooling when placed in driven relationship with the engine and not to force ambient air to contribute to engine cooling when placed in non-driven relationship with the engine, the method comprising:

processing engine speed data, reference engine speed data, and selected rate of change of engine speed data to indicate engine speed exceeding a reference engine speed and to indicate rate of change of engine speed exceeding a selected rate of change of engine speed;

processing vehicle speed data and reference vehicle speed data to indicate vehicle speed exceeding a reference vehicle speed;

and placing the cooling fan in non-driven relationship with the engine when vehicle speed exceeding the reference vehicle speed is indicated coincident with indication of either engine speed exceeding the reference engine speed or rate of change of engine speed exceeding the selected rate of change of engine speed.

11. A method as set forth in claim 10 in which the step of processing engine speed data, reference engine speed data, and selected rate of change of engine speed data to indicate engine speed exceeding a reference engine speed and to indicate rate of change of engine speed exceeding a selected rate of change of engine speed comprises:

comparing engine speed data to diminished engine speed reference data that defines an engine speed less than the reference engine speed, from a time at which the comparing step indicates engine speed beginning to exceed the reference engine speed until a time at which the comparing step indicates engine speed ceasing to exceed the diminished engine speed reference, continuing the indication that engine speed exceeds the reference engine speed, and discontinuing the indication that engine speed exceeds the reference engine speed when the comparing step indicates engine speed ceasing to exceed the diminished engine speed reference.

12. A method as set forth in claim 10 including the additional steps of processing other data through an AND logic function for requesting the cooling fan be placed in non-driven relationship with the engine only when all such other data call for the cooling fan to be placed in non-driven relationship with the engine, and processing the result of processing the other data through the AND logic function and the results of the first-mentioned and second-mentioned processing steps through an OR logic function to cause the cooling fan to be placed in non-driven relationship with the engine when either the AND logic function is requesting such placement or when the second-mentioned processing step indicates vehicle speed exceeding the reference vehicle speed coincident with the first-mentioned processing step indicating either engine speed exceeding the reference engine speed or rate of change of engine speed exceeding the selected rate of change of engine speed.

13. A method as set forth in claim 9 in which the step of placing the cooling fan in non-driven relationship with the engine overrides any other request requesting that the cooling fan be placed in driven relationship with the engine.

14. A motor vehicle comprising:

a heat engine that powers the vehicle and comprises an engine cooling fan coupled to the engine through an interface that is operable to selectively place the cooling fan in driven and non-driven relationship with the engine, and a control system that, with the engine running, controls the interface to place the cooling fan selectively in driven relationship with the engine for forcing ambient air to contribute to engine cooling and in non-driven relationship with the engine to discontinue forcing ambient air to contribute to engine cooling, that processes certain data for indicating when engine speed exceeds a reference engine speed, for indicating when vehicle speed exceeds a reference vehicle speed, and for indicating when rate of change of engine speed exceeds a selected rate of change of engine speed, and that causes the interface to place the cooling fan in non-driven relationship with the engine when the processing of the data discloses vehicle speed exceeding the reference vehicle speed coincident with the processing of the data disclosing either engine speed exceeding the reference engine speed or rate of change of engine speed exceeding the selected rate of change of engine speed.

15. A motor vehicle as set forth in claim 14 in which the vehicle comprises a liquid cooling system for the engine including a radiator through which engine coolant circulates, and the cooling fan is arranged to force ambient air through the radiator to contribute to engine cooling.

16. A motor vehicle as set forth in claim 14 in which the control system processes additional data to develop multiple requests for placing the cooling fan either in driven relationship with the engine or in non-driven relationship with the engine, and causes the cooling fan to be placed in non-driven relationship with the engine either A) only when all such multiple requests are requesting the cooling fan to be placed in non-driven relationship with the engine, or B) when the processing of certain data for indicating when engine speed exceeds a reference engine speed, for indicating when vehicle speed exceeds a reference vehicle speed, and for indicating when rate of change of engine speed exceeds a selected rate of change of engine speed discloses vehicle speed exceeding the reference vehicle speed coincident with disclosure of either engine speed exceeding the reference engine speed or rate of change of engine speed exceeding the selected rate of change of engine speed.

* * * * *